United States Patent [19]

Halpern

[11] 4,453,715

[45] Jun. 12, 1984

[54] THREE-DIMENSIONAL PUZZLE

[75] Inventor: Benjamin R. Halpern, Bloomington, Ind.

[73] Assignee: Uwe Meffert, Causeway Bay, Hong Kong

[21] Appl. No.: 303,127

[22] Filed: Sep. 17, 1981

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 3,690,672 | 9/1972 | Dreyer | 273/155 |

FOREIGN PATENT DOCUMENTS

| | | | |
|---|---|---|---|
| 8104382 | 7/1981 | Fed. Rep. of Germany | 273/153 S |
| 170062 | 12/1977 | Hungary | 273/153 S |
| 55-3956 | 1/1980 | Japan | 273/153 S |
| 55-8192 | 3/1980 | Japan | 273/153 S |
| 55-8193 | 3/1980 | Japan | 273/153 S |

OTHER PUBLICATIONS

Scientific American, Mar. 1981, pp. 20–22, 25–28, 30, 32, 35, 39.

*Primary Examiner*—Anton O. Oechsle
*Attorney, Agent, or Firm*—Lyon & Lyon

[57] ABSTRACT

An oblique twistable 3-dimensional puzzle consists of an assemblage of parts where the organization of these parts is based on a guiding polyhedron which is an imagined oblique polyhedron. The guiding polyhedron is subdivided into pieces, with one center piece, and one piece for each face, edge, and vertex of said guiding polyhedron. The parts of said assemblage can be arranged so that for each part of said assemblage there is a corresponding piece of said subdivided guiding polyhedron and vice versa, and when said parts are so arranged they give the appearance of a single subdivided solid figure. The parts of said assemblage are held to one another by means pivotally connecting the face parts to the center part, and extensions of the edge and vertex parts with matching channels in the center, face, and edge parts. The parts corresponding to a face of said guiding polyhedron may be rotated as a block with respect to the other parts by 360°. For symmetric examples of an oblique twistable 3-dimensional puzzle, some of said blocks may be rotated by some fraction of 360° and brought into new positions. In said new positions the overall configurations of the parts of said assemblage are essentially the same as the configuration before said rotations. Said rotations allow the parts of a symmetric example of an oblique twistable 3-dimensional puzzle to be permuted in a plurality of ways. Said puzzle's challenge is to restore said puzzle, the parts of which have been permuted, to its original unpermuted configuration by performing the appropriate rotations.

4 Claims, 36 Drawing Figures

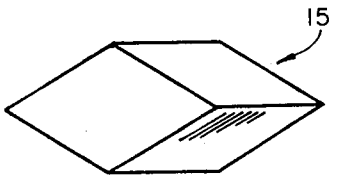
Fig.9
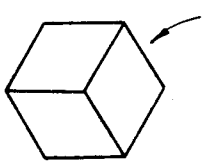
Fig.10
Fig.11
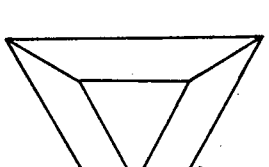
Fig.12
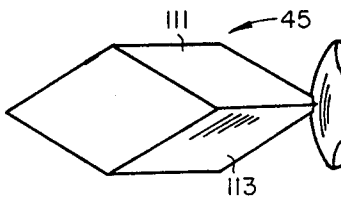
Fig.13
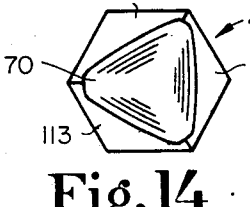
Fig.14
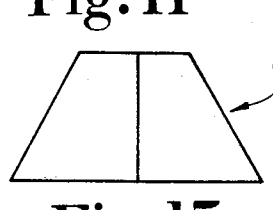
Fig.15
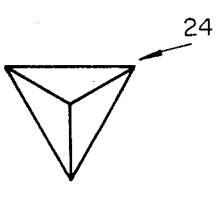
Fig.16
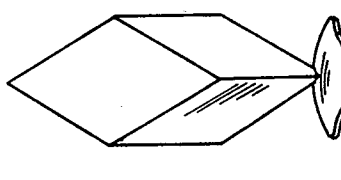
Fig.17
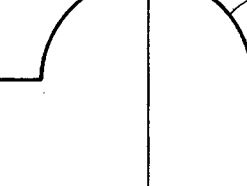
Fig.18
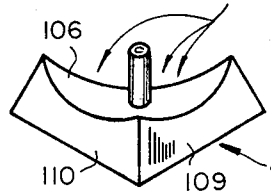
Fig.19
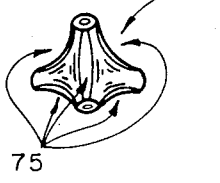
Fig.20

THREE-DIMENSIONAL PUZZLE

BACKGROUND OF THE INVENTION

1. Field of the Invention

This invention relates in general, to 3-dimensional rearrangement puzzles and in particular, to three-dimensional rearrangement puzzles which hold together.

2. Description of the Prior Art

The following list comprises those patent documents of which I am aware which are closest to the present puzzle: Hungarian No. 170062, Rubik; Japenese Nos. 55-8192, 55-3956 and 55-8193, Ishige.

Rubik has disclosed a puzzle based on the shape of a cube. Although the outward appearance of Rubik's puzzle may take many forms, the organization of the parts is that of a cube subdivided into 27 little cubes which are stacked in rows, columns, and layers in a $3\times3\times3$ pattern. Rubik has also disclosed a puzzle whose parts are organized by a cube subdivided into 8 little cubes which are stacked in rows, columns, and layers in a $2\times2\times2$ pattern. In each of these puzzles the parts comprising any face of the large organizing cube may be rotated by 90°, 180°, and 270° and so, bring all the parts into a new configuration essentially the same as the original configuration. The parts hold each other together by a series of axles, extensions and channels.

Ishige has disclosed in his three patent documents, puzzles very similar to the two puzzles Rubik has disclosed, but with alternate patterns of extensions and channels to hold the parts together. In Douglas Hofstadter's *Scientific American* article (March 1981, page 39) and in David Singmaster's *Notes On Rubik's "Magic Cube"*, two other similar puzzles are said to be under development. These two puzzles are described as being based on rectangular parallelepipeds which are subdivided into little cubes which are stacked in rows, columns, and layers in a $2\times3\times3$ pattern for one puzzle and in a $4\times4\times4$ pattern for the other puzzle.

Each of these prior art puzzles differs from each of the present puzzles in each of the following ways.

1. Each is organized by the shape of a rectangular parallelepiped.

2. Each is subdivided by three systems of parallel planes, one system parallel to each pair of parallel faces of said rectangular parallelpiped 3. The component parts are stacked in rows, columns, and layers.

4. The allowed rotations, those which bring the parts into a new configuration essentially the same as the original configuration, are each either 90°, 180°, or 270° rotations.

5. Each face has the 180° rotation as an allowed rotation.

6. The axes about which the allowed rotations may be performed are mutually perpendicular.

7. There are exactly 3 such axes.

8. Each of these prior art puzzles has a spatial organization of its parts into blocks which may be rotated with respect to those parts not in the block, and this spatial organization is different from the spatial organization of each of the present puzzles.

9. Both the prior art puzzles and the present puzzles have rearrangement problems, a rearrangement problem being the problem of restoring the parts to their exact original positions after they have been permuted in an arbitrary manner. The rearrangement problem posed by each of the prior art puzzles is essentially different from the rearrangement problem posed by each of the present puzzles.

SUMMARY OF THE INVENTION

An oblique twistable 3-dimensional puzzle consists of an assemblage of parts where the organization of these parts is based on a guiding polyhedron which is an imagined oblique polyhedron. The guiding polyhedron is subdivided into pieces. The parts of said assemblage can be arranged so that for each part of said assemblage there is a corresponding piece of said subdivided guiding polyhedron and vice versa, and each part of said assemblage is in approximately the same location as the corresponding piece of the subdivided guiding polyhedron. The parts of said assemblage are held together by means pivotally connecting some parts and by extensions and channels. Certain groups of parts may be rotated as a block by 360° with respect to the other parts. For symmetric examples of an oblique twistable 3-dimensional puzzle, some of said groups of parts may be rotated by some fraction of 360° and brought into new positions. In said new positions the overall configurations of the parts of said assemblage are essentially the same as the configuration before said rotations. Said rotations allow the parts of a symmetric example of an oblique twistable 3-dimensional puzzle to be permuted in a plurality of ways. Said puzzle's challenge is to restore said puzzle, the parts of which have been permuted, to its original unpermuted configuration by performing the appropriate rotations.

PRELIMINARY DISCUSSION

The invention described here can take an infinite number of essentially different forms. This is because the construction of an oblique twistable 3-dimensional puzzle may be guided by any oblique polyhedron.

In order to clarify the essential aspects of a guiding polyhedron, we enunciate the following concepts. The term polyhedron will be used in the mathematical sense to denote a solid figure with only flat faces which meet in straight edges and vertices. Each face of said polyhedron is a polygon with three or more sides and three or more vertices. The sides of said polygon are edges of said polyhedron. Each edge of said polyhedron is a side of two faces of said polyhedron.

We use the term "incident" in the mathematical sense, where a vertex of a polyhedron is incident with an edge of said polyhedron, provided said vertex is one of the end points of said edge. An edge of said polyhedron is incident with a face of said polyhedron, provided said edge is a side of said face. A vertex of said polyhedron is incident with a face of said polyhedron if said vertex is a vertex of said face.

A polyhedron is 3-valent, provided that for each vertex of said polyhedron there are exactly three faces of said polyhedron incident with said vertex. Two polyhedra are equivalent if it is possible to find a one to one correspondence between the vertices, edges, and faces of one of the said polyhedra and the vertices, edges, and faces, respectively, of the other of the said polyhedra so that if a vertex of the first said polyhedron is incident with an edge of the first said polyhedron, then the vertex of the second said polyhedron corresponding to the said vertex of the first polyhedron is incident with the edge of the second polyhedron corresponding to the said edge of the first polyhedron, and similarly with vertices and faces, and with edges and faces. Two polyhedron are inequivalent if they are not equivalent. A polyhedron is oblique provided it is convex, 3-valent, and inequivalent to a cube. It should be noted that a solid rectangular parallelepiped is equivalent to a cube, and so an oblique polyhedron is inequivalent to each solid rectangular parallelepiped.

An oblique twistable 3-dimensional puzzle is an assemblage of parts. The parts of said assemblage can be arranged in an allowable arrangement. In an allowable arrangement the parts of said assemblage appear to form a solid figure, and said parts are organized by a guiding polyhedron. A guiding polyhedron is an imagined oblique polyhedron. Said solid figure may be any polyhedron or sphere or any amorphous shape. In particular, said solid figure is not restricted by the choice of the guiding polyhedron. The guiding polyhedron is used only to help describe the organization of the parts of said assemblage and to help describe the interfaces between said parts.

BRIEF DESCRIPTION OF THE DRAWINGS

FIG. 9 is a side view of a vertex piece.

FIG. 10 is a front view of a vertex piece.

FIG. 11 is a top view of a face piece.

FIG. 12 is a edge view of the center piece.

FIG. 13 is a side view of a vertex part.

FIG. 14 is a front view of a vertex part.

FIG. 15 is a front view of a face piece.

FIG. 16 is a top view of the center piece.

FIG. 17 is a side view of a vertex part in an alternative embodiment.

FIG. 18 is a cross section of a particular surface of revolution with its line of symmetry.

FIG. 19 is a pictorial view of a face part.

FIG. 20 is a pictorial view of the center part.

DESCRIPTION OF PREFERRED EMBODIMENT

For the purpose of promoting an understanding of the principles of the invention, and in particular of how the guiding polyhedron is used to organize the parts of an oblique twistable 3-dimensional puzzle, we will now describe a particular embodiment of the present invention where the guiding polyhedron is a regular tetrahedron. Reference will now be made to the embodiment illustrated in FIGS. 1–6, 8–16, 19–22, and 24–31, and specific language will be used to describe the same. It will nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates. In particular, it should be kept in mind that any oblique polyhedron can be used as the guiding polyhedron.

Figure 2:
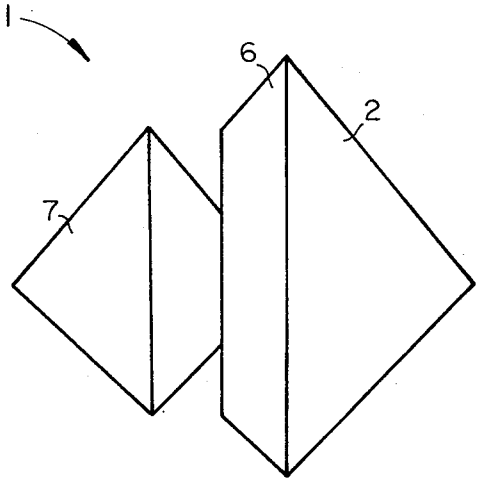
FIG. 2 is an exploded view of a guiding polyhedron divided into a forward and back section with respect to a particular face.
Figure 1:
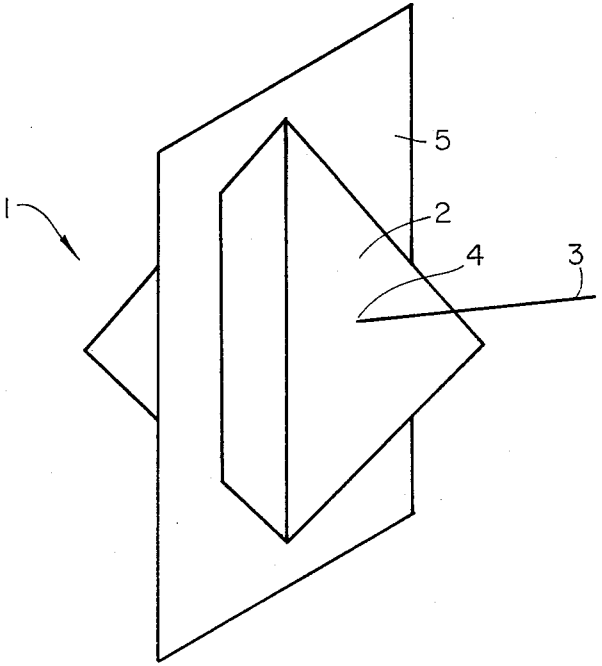
FIG. 1 is a perspective view of a guiding polyhedron with an axis line and a dividing surface corresponding to a particular face of the guiding polyhedron.
Figure 3:
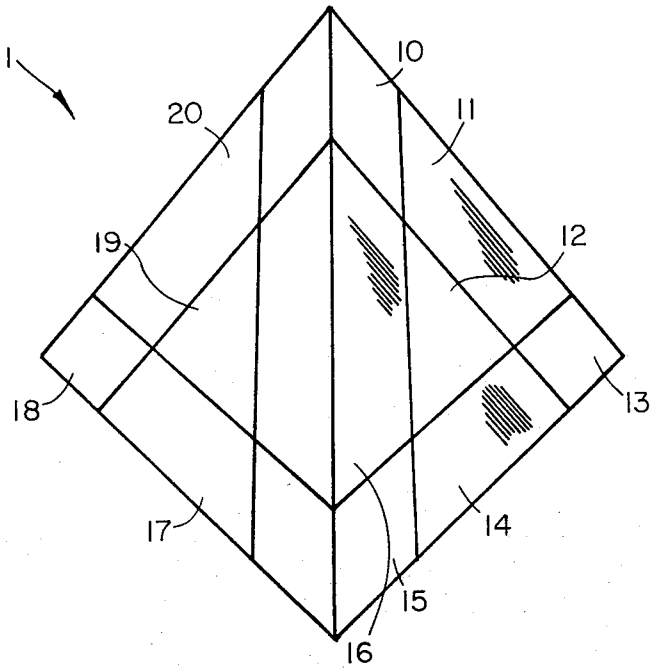
FIG. 3 is an edge view of a subdivided guiding polyhedron.
Figure 4:
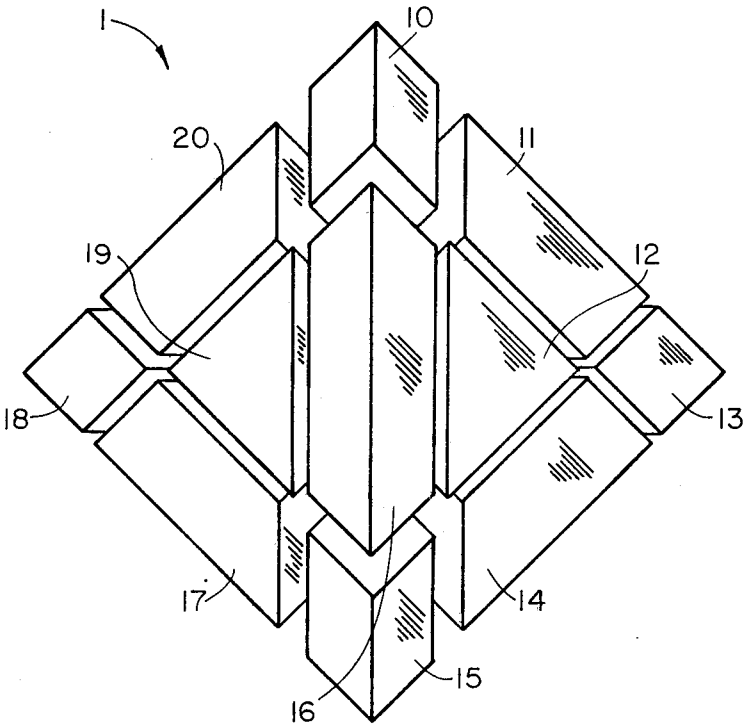
FIG. 4 is a partially exploded view of FIG. 3.

The guiding polyhedron 1 is shown in FIG. 1. Consider a face 2 of the guiding polyhedron 1. For each such face there is an axis line 3. Axis line 3 is any straight line which intersects face 2 in one point 4, where point 4 is in the interior of face 2. In the preferred embodiment being described, axis line 3 is perpendicular to face 2 and point 4 is the center point of face 2. There is a dividing surface 5 corresponding to face 2. The dividing surface 5 is a surface of revolution about the axis line 3, where a surface of revolution about a straight line is any surface obtained as follows. Take any plane which contains said straight line and take any curve in said plane. Sweep out a surface by rotating said curve by 360° about said line. Said line is the line of symmetry of said surface of revolution and said curve is a cross section of said surface of revolution. In the present embodiment the dividing surface 5 is a plane perpendicular to the axis line 3. The dividing surface 5 cuts the guiding polyhedron into two sections, section 6 and section 7 (FIG. 2). Section 6 contains the face 2 and is the forward section associated to the face 2. The other section, section 7, is the back section associated to the face 2.

Figure 5:
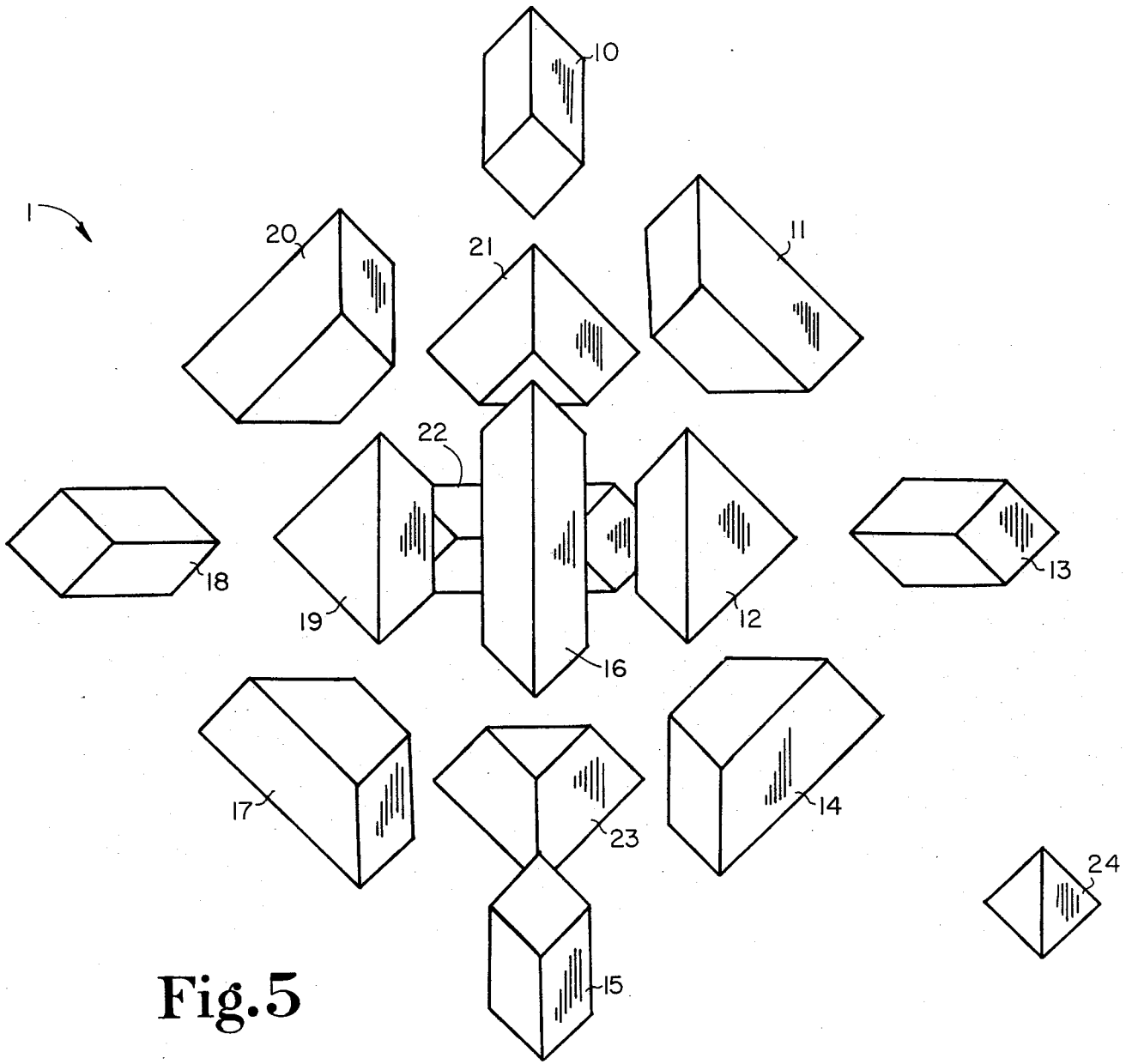
FIG. 5 is a completely exploded view of FIG. 3.
Figure 6:
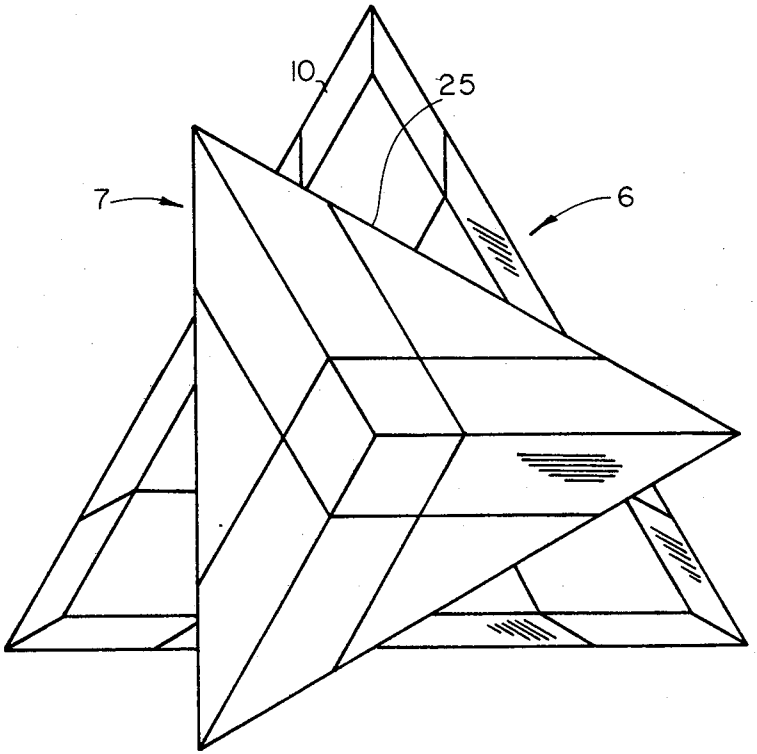
FIG. 6 is a subdivided guiding polyhedron with one forward section rotated with respect to the corresponding back section.

As described above there is one dividing surface associated to each face of the guiding polyhedron 1. These dividing surfaces taken all together cut the guiding polyhedron 1 into a plurality of pieces which are of four types (See FIGS. 3, 4 and 5). All the pieces 10–24 are shown in FIG. 5 and only pieces 10–20 are visible in FIGS. 3 and 4. The term "intersection" will be used in the following mathematical sense. The intersection of two or more sections of the guiding polyhedron 1 is that portion of the guiding polyhedron common to all the said sections.

There is one center piece 24, which is in the center of the guiding polyhedron 1. In FIG. 5 the center piece 24 is drawing to the side and there is a looped arrow indicating where it should be normally. The center piece 24 is the intersection of all the back sections.

There are four face pieces, pieces 12, 19, 21, and 23, one associated to each of the four faces of the guiding polyhedron 1. Each face piece is the intersection of one forward section and three back sections.

There are six edge pieces, pieces 11, 14, 16, 17, 20, and 22, one associated to each of the six edges of the guiding polyhedron 1. Each edge piece is the intersection of two forward sections and two back sections.

The dividing surfaces are required to be such that when the guiding polyhedron 1 is cut by all said dividing surfaces, each of the pieces 10–24 are actually formed and no other pieces are formed. In the present embodiment this requirement is satisfied provided the forward sections, such as section 6 (FIG. 2), are thin enough, where thin enough means precisely that the thickness of each forward section is less than one fourth the height of the guiding polyhedron 1. It is also required that when a forward section, such as section 6 (shown at the bottom in FIG. 6), is rotated by any angle about the corresponding axis line 3 (see FIG. 1), (in FIG. 6 axis line 3 is perpendicular to the paper) each piece in forward section 6, such as the vertex piece 10, makes contact with the corresponding back section 7 in some place such as 25. In the present embodiment, this will be so if the thicknesses of the forward sections are equal to each other and greater than one sixth the height of the guiding polyhedron 1.

Figure 8:
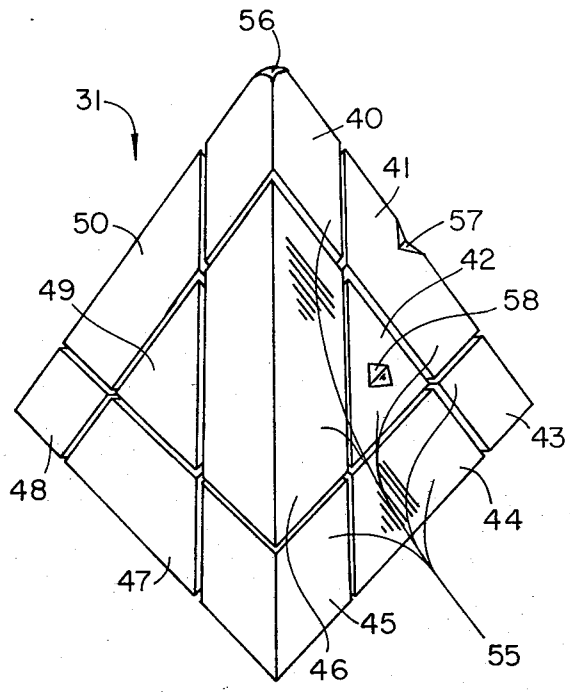
FIG. 8 is an edge view of an oblique twistable 3-dimensional puzzle which illustrates an allowed arrangement of the parts of an oblique twistable 3-dimensional puzzle.

An oblique twistable 3-dimensional puzzle is an assemblage of parts. In the present embodiment said assemblage 31 is shown in FIG. 8. It will be noted that reference numerals used for parts of the assemblage 31 are not the same as for related pieces of the guiding polyhedron 1. This will be appreciated as the description proceeds. The parts 40–54 of said assemblage 31 (only parts 40–50 are visible in FIG. 8) are organized by the guiding polyhedron 1 as follows:

The parts of the assemblage 31 can be arranged in an allowed arrangement. FIG. 8 illustrates an allowed arrangement. In the present perferred embodiment, where the guiding polyhedron is a regular tetrahedron, there are 7,255,941,120 distinct allowed arrangements. In an allowed arrangement the parts of the assemblage 31 appear to form a subdivided solid figure. In the preferred embodiment said solid figure can be described as being constructed from a tetrahedron by rounding one vertex, denting one edge and adding a raised portion to one face. Also, in an allowed arrangement (see FIG. 8) the parts 40–54 of the assemblage 31 correspond to the pieces 10–24 of the subdivided guiding polyhedron 1 (see FIG. 4) so that to each part of the assemblage 31, such as part 40, there is a corresponding piece, which in the case of part 40 is a piece 10 of the subdivided guiding polyhedron 1, and vice versa. For the allowed arrangement illustrated in FIG. 8, part 40 corresponds to piece 10, part 41 corresponds to piece 11, part 42 correspond to piece 12, etc. Furthermore, each part, such as part 40, of the assemblage 31 is approximately in the same location as the corresponding piece 10 of the subdivided guiding polyhedron 1.

The center part 54 (see FIG. 20) is the part of the assemblage which corresponds to the center piece 24 (see FIGS. 5, 12 and 16). The face parts 42, 49, 51 and 53 (in FIG. 8 face parts 51 and 53 are hidden from view, see also FIG. 19) are the parts of the assemblage 31 which correspond to the face pieces 12, 19, 21, and 23 respectively (see FIGS. 5, 11 and 15). The edge parts 41, 44, 46, 47, 50 and 52 (in FIG. 8 edge part 52 is hidden from view, see also FIG. 22) are the parts of the assemblage 31 which correspond to the edge pieces 11, 14, 16, 17, 20 and 22 respectively (see FIGS. 5 and 21). The vertex parts 40, 43, 45 and 48 (see FIGS. 8, 13 and 14) are the parts of the assemblage 31 which correspond to the vertex pieces 10, 13, 15 and 18 (see FIGS. 4, 9 and 10).

With respect to a particular allowed arrangement, such as the allowed arrangement pictured in FIG. 8, corresponding to each face, such as face 2 (FIG. 1), of the guiding polyhedron 1, there is a block 55 (see FIG. 8). The block 55 consists of the collection of parts of the assemblage 31 which correspond to pieces contained in the forward section 6 (FIG. 2) which corresponds to the face 2. The block 55 is the collection of parts 40–46. The axis line corresponding to the block 55 is the axis line 3 which corresponds to the corresponding face 2 (FIG. 1). With respect to an allowed arrangement, such as pictured in FIG. 8, each part, such as part 40, of the assemblage 31 has a shape which sufficiently resembles the shape of the corresponding piece 10 of the subdivided guiding polyhedron 1 (see FIG. 4), so that each block of said allowed arrangement, such as block 55, can be rotated by 360° with respect to the rest of the parts of the assemblage 31 about the axis line 3 which corresponds to the block 55.

It should be noted that the parts of the assemblage 31 only resemble the corresponding pieces of the subdivided guiding polyhedron 1, and in particular, the vertex part 40 looks like the corresponding vertex piece 10, but the corner 56 of the vertex part 40 is rounded, the edge part 41 has an indentation 57 not found on the corresponding edge piece 17, the face part 42 has a raised portion 58 which is not found on the corresponding face piece 12, and the edge part 44 is hollow (this is not shown in FIG. 8) and the corresponding edge piece 14 is solid. Other more essential differences between each part of the assemblage 31 and its corresponding piece of the subdivided guiding polyhedron 1 are described below.

The parts of the assemblage 31 are held together in the following manner. For each face part, such as face part 42 (see FIG. 19), there is some means such as pin 60 (FIG. 25), for example, pivotally connecting the face part 42 to the center part 54 (see FIGS. 20, 24 and 25). The face part 42 is free to rotate about the axis line 61 corresponding to the face part 42.

When the parts 40–54 of the assemblage 31 are arranged in an allowed arrangement, such as pictured in FIG. 8, each vertex part, such as vertex part 45 (see FIGS. 13, 14 and 26–29), extends below the visible surface of the subdivided solid figure (see FIG. 8) which the assemblage 31 appears to form, towards the adjacent parts. (In FIGS. 28 and 29 the vertex part 40 is shown without its rounded corner 56 (FIG. 8) indicated.) FIGS. 9 and 10 show the vertex piece 15 of the subdivided guiding polyhedron 1. FIGS. 13 and 14 show the corresponding vertex part 45 and its extension 70 which is that portion of the vertex part 45 which extends towards the adjacent parts of the assemblage 31 in said allowed arrangement.

Figure 21:
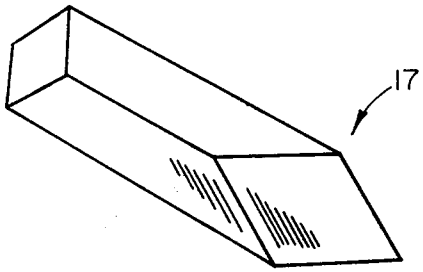
FIG. 21 is a perspective view of an edge piece.
Figure 22:
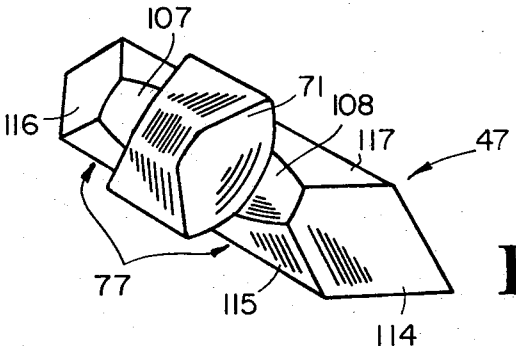
FIG. 22 is a perspective view of an edge part.

Each edge part, such as edge part 47, extends below the visible surface of said subdivided solid figure towards the adjacent face parts 53 and 49 (see FIGS. 26 and 27) and towards the center part 54. FIG. 21 shows the edge piece 17 of the subdivided guiding polyhedron 1. FIG. 22 shows the corresponding edge part 47 and the extension 71 which is that portion of the edge part 47 which extends towards the adjacent face parts 53 and 49 and towards the center part 54.

Figure 27:
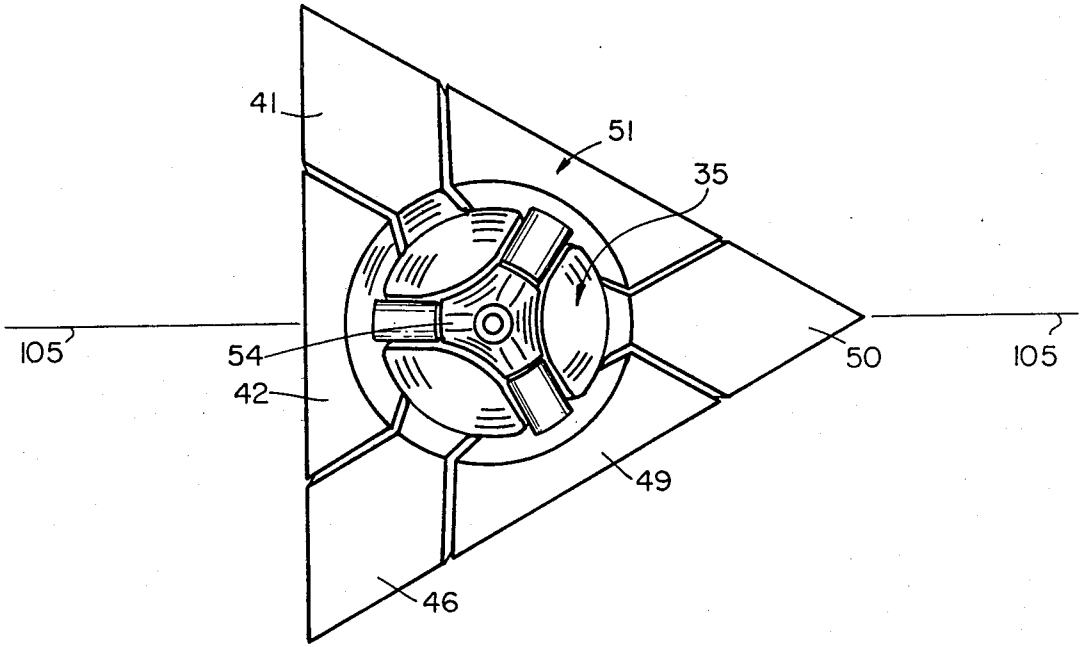
FIG. 27 is a bottom view of the parts of the puzzle of FIG. 8 not in the block shown in FIG. 26.
Figure 27A:
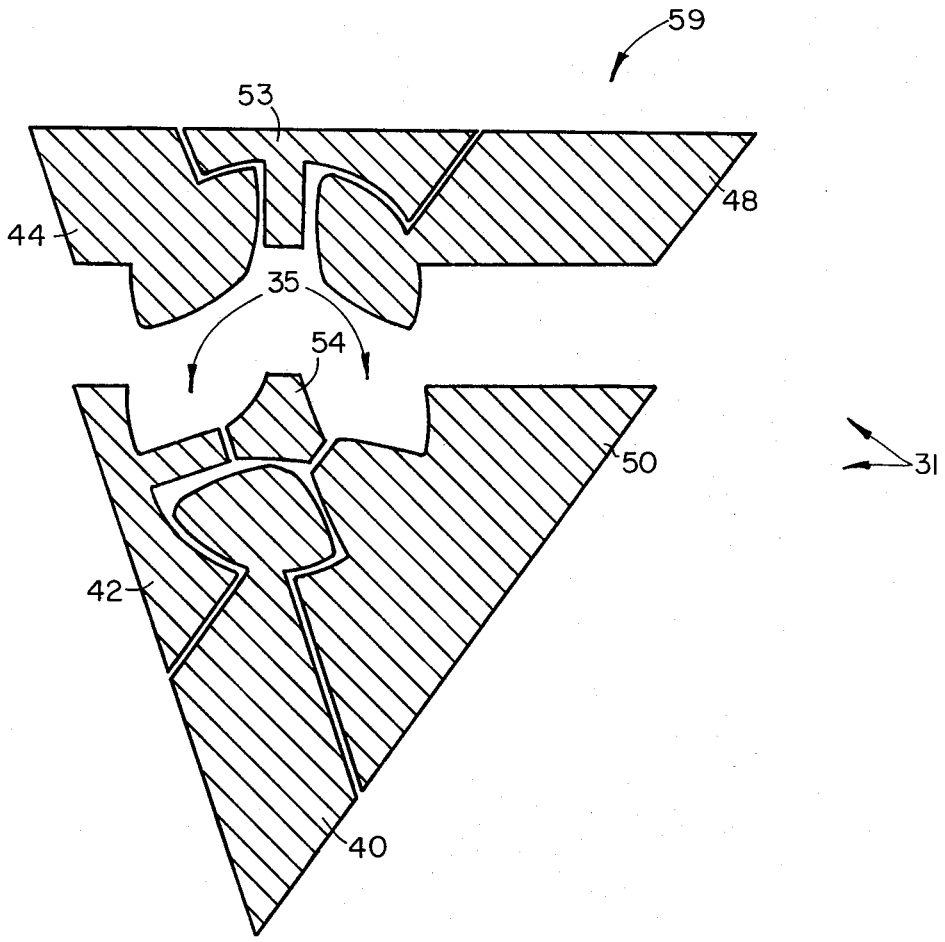
FIG. 27A is a cross sectional view of an oblique twistable 3-dimensional puzzle with the block of FIG. 26 separated from the parts of FIG. 27 to show a channel in the remaining parts.
Figure 28:
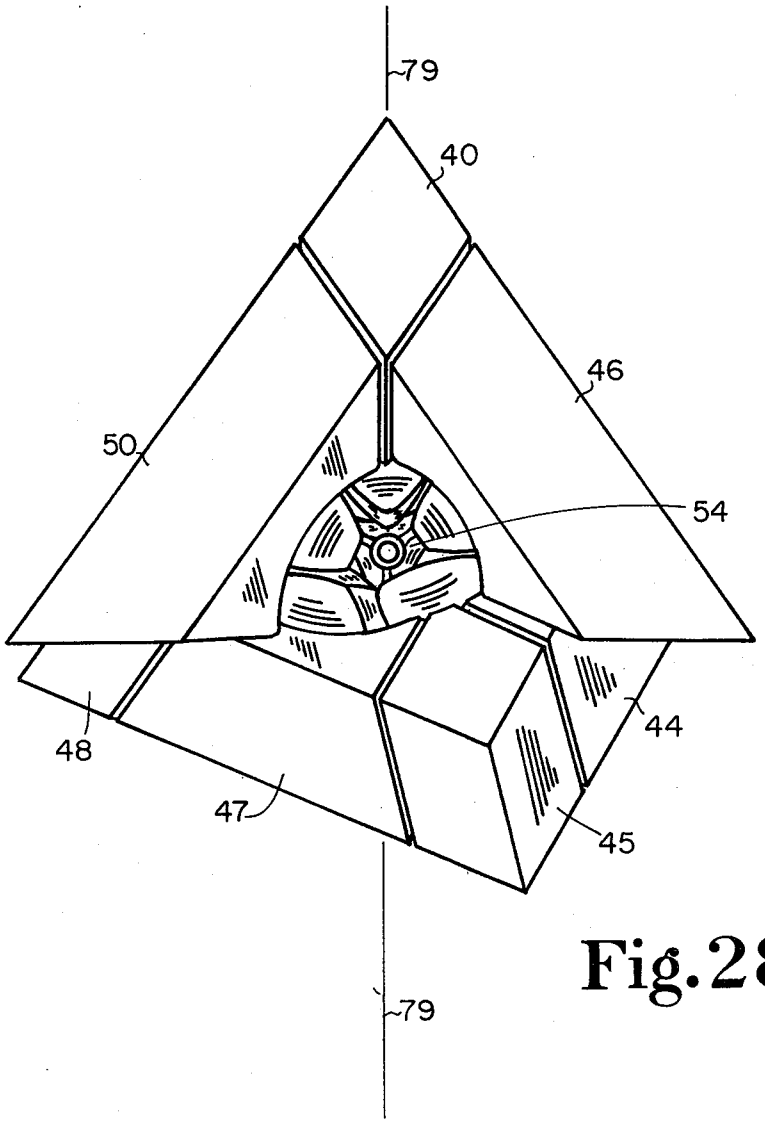
FIG. 28 is a pictorial view of an oblique twistable 3-dimensional puzzle with one block rotated and one face part removed to reveal some of the insides.
Figure 29:
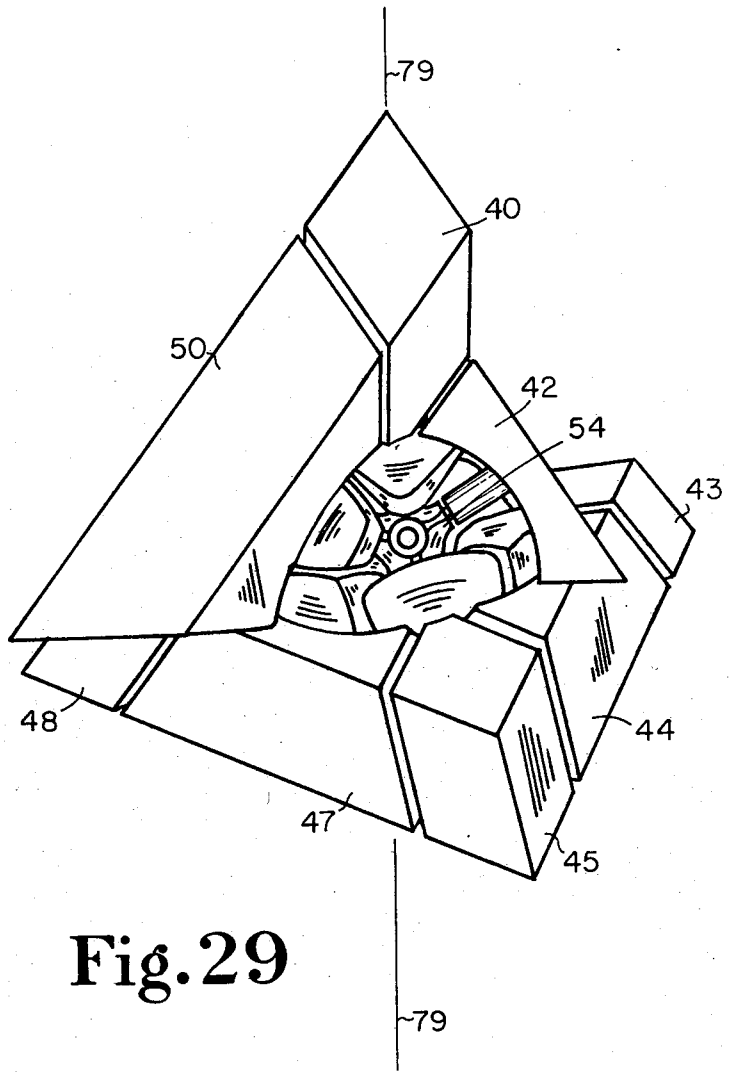
FIG. 29 is a pictorial view of an oblique twistable 3-dimensional puzzle with one block rotated, one face part removed, and one edge part removed.

FIG. 27A shows a cross section of the assemblage 31 with the block 59 separated from the other parts of the assemblage 31. The plane 105 of said cross section is indicated in both FIG. 26 and FIG. 27. For each block, such as block 59 (see FIG. 26), there is a circular channel 35 (see FIGS. 27 and 27A) in the group of parts, parts 51, 50, 49, 46, 42, 54 and 41, not in the block 59 but adjacent to it. These circular channels, such as channel 35, are composed of channels in the center part, face parts, and edge parts of the assemblage 31.

FIGS. 12, 16, 11, 15 and 21 show the center pieces 24, the face piece 12, and the edge piece 17 of the subdivided guiding polyhedron 1. FIGS. 20, 19 and 22 show the corresponding center part 54, face part 42, and edge part 47 of the assemblage 31. The center part 54, the face parts, such as face part 42, and the edge parts, such as edge part 47, have channels 75, 76 and 77 respectively. The extensions, such as extensions 70 and 71 in FIGS. 13, 14 and 22, and the channels, such as channels 75, 76 and 77 in FIGS. 20, 19 and 22, are such that when each block, such as block 59 in FIG. 26 (block 59 consists of parts 43, 44, 45, 47, 48, 52 and 53), is rotated by 360° with respect to the rest of the assemblage (see FIGS. 26–29) about the axis line 79 corresponding to said block 59, the extensions of those parts of the assemblage 31 which are contained in the block 59 fit into the channels in the parts 41, 42, 46, 49, 50, 51 and 54, of the assemblage 31 which are not contained in the block 59 and which are adjacent to it. During such a rotation, sufficient contact is made between the parts of the assemblage 31 and their extensions and channels so that in conjunction with said means pivotally connecting the face parts 42, 49, 51 and 53 to the center part 54, the parts of the assemblage 31 are held together.

Figure 30:
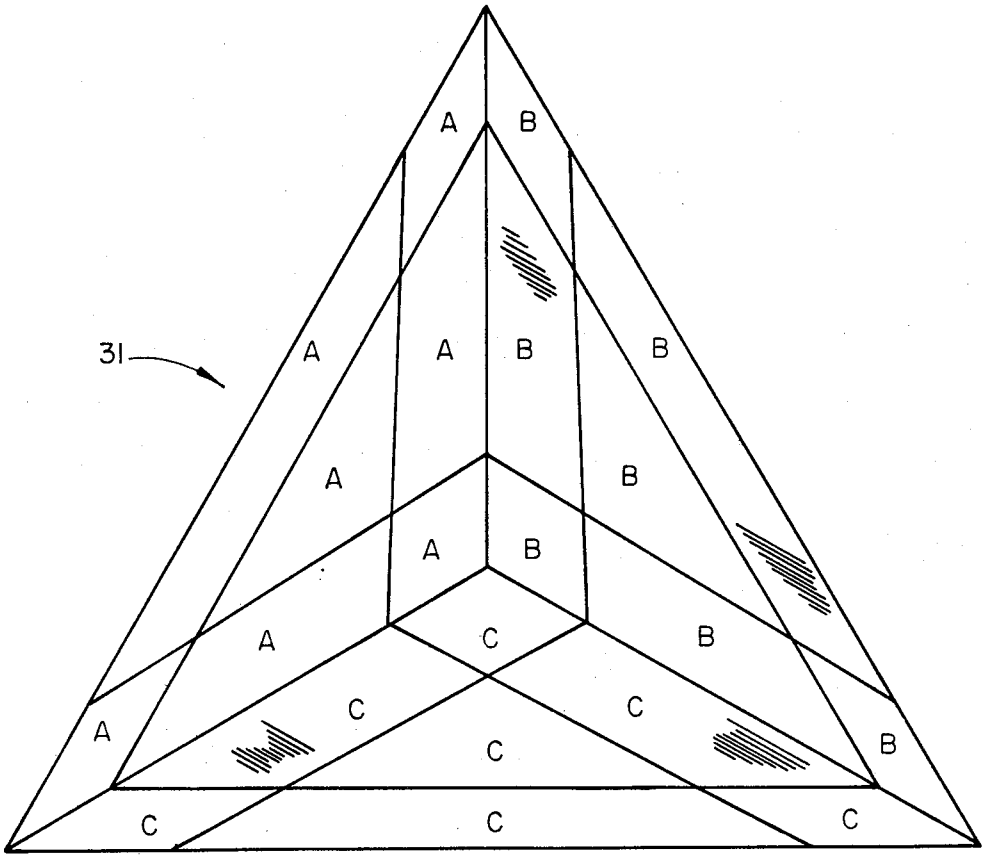
FIG. 30 is a top view of an oblique twistable 3-dimensional puzzle with a coloring scheme indicated.
Figure 31:
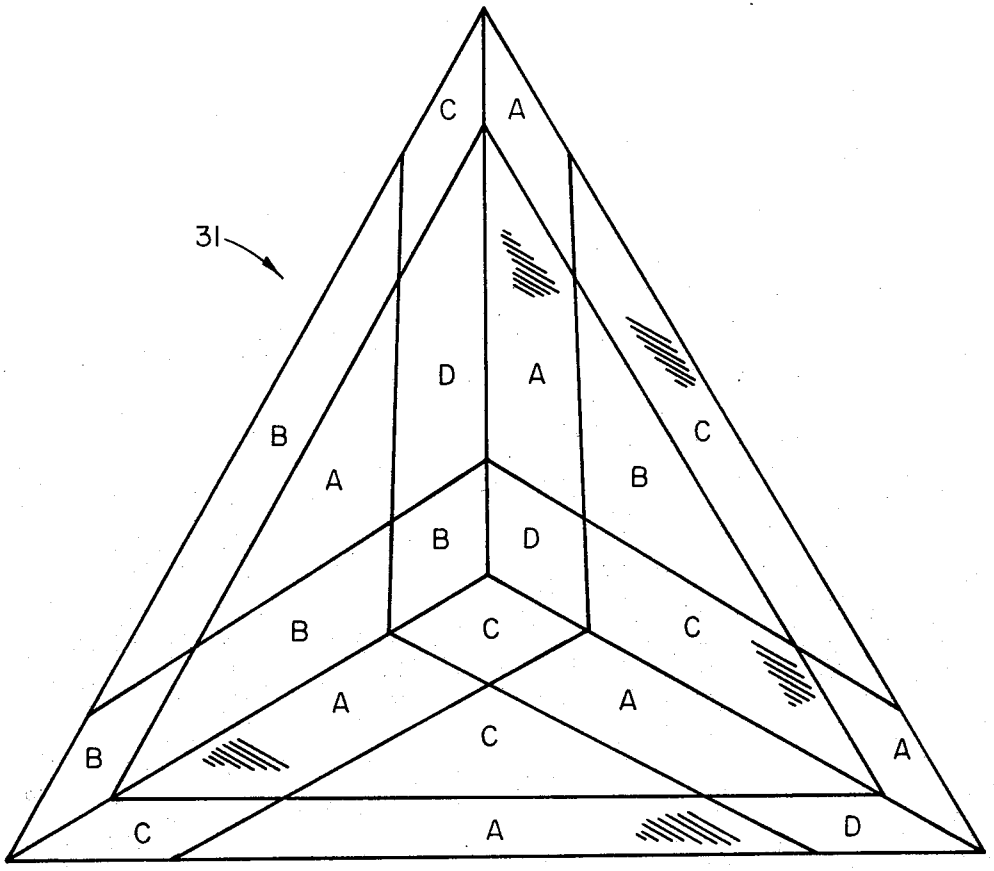
FIG. 31 is a top view of an oblique twistable 3-dimensional puzzle with its parts permuted.

The parts 40–54 of the assemblage 31 are colored or otherwise decorated so that some allowed arrangements can be distinguished. In FIG. 30 different colors are indicated by different letters.

The description of the preferred embodiment of an oblique twistable 3-dimensional puzzle is complete. The puzzle is used as follows. Any block, such as block 59 (see FIG. 26), may be rotated by 360°/3, i.e. 120°. After such a rotation the parts 40–54 of the assemblage 31 are arranged in a new allowed arrangement. Any block of this new allowed arrangement may now be rotated by 360°/3 bringing the parts 40–54 of the assemblage 31 into yet another allowed arrangement. When such rotations are made, the edge parts 41, 44, 46, 47, 50 and 52 and the vertex parts 40, 43, 45 and 48 are permuted amongst themselves (see FIG. 31). The challenge of the puzzle is to manipulate a puzzle, the parts of which have been permuted as in FIG. 31, into its original allowed arrangement as shown in FIG. 30, or into some other distinguished allowed arrangement by making the appropriate rotations.

DISCUSSION OF OTHER EMBODIMENTS

Figure 32:
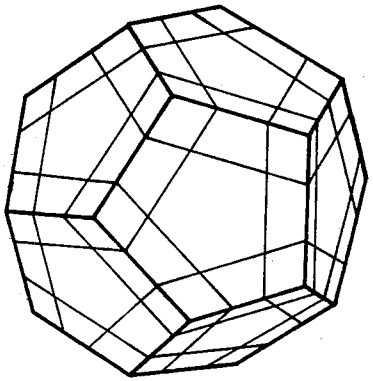
FIG. 32 is an oblique twistable 3-dimensional puzzle with a regular dodecahedron as the guiding polyhedron.
Figure 33:
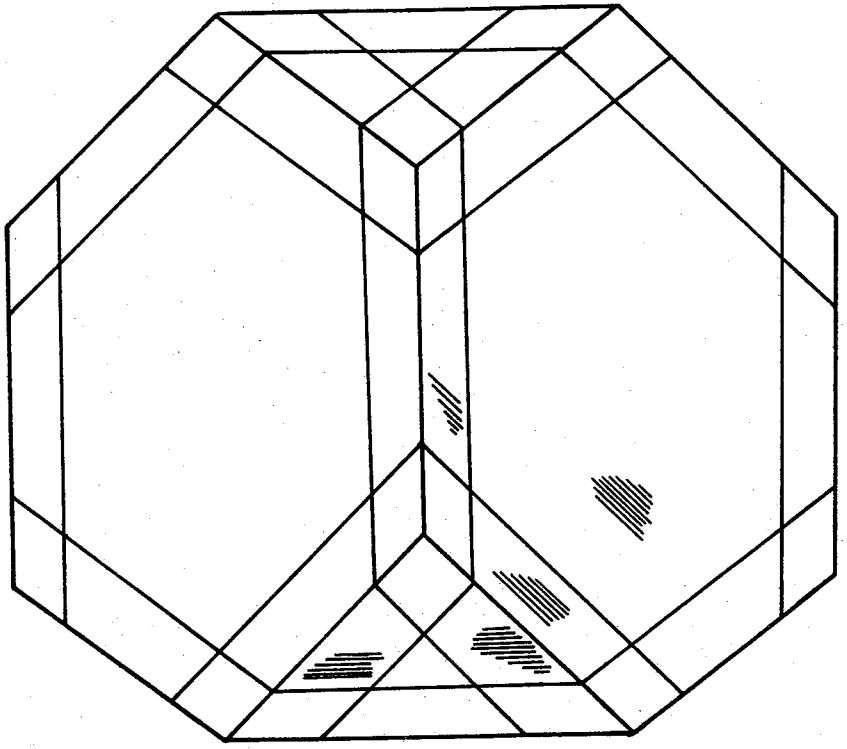
FIG. 33 is an oblique twistable 3-dimensional puzzle with a truncated tetrahedron as the guiding polyhedron.

While the invention has been illustrated and described in detail in the foregoing drawings and description, the same is to be considered as illustrative and not restrictive in character, it being understood that only the preferred embodiment where the guiding polyhedron is a regular tetrahedron has been shown and described in detail and that all changes and modifications that come within the spirit of the invention are desired to be protected. In particular, other embodiments of this invention are obtained by using other oblique polyhedra as the guiding polyhedra. FIGS. 32 and 33 give examples of the outward appearances of oblique twistable 3-dimensional puzzles with guiding polyhedra which are a regular dodecahedron and truncated tetrahedron respectively. These examples merely illustrate the wide variety of forms this invention may take and are in no way exhaustive of such possibilities.

Although planes perpendicular to the axis lines were used for the dividing surfaces in the above description of the preferred embodiment, much more general surfaces of revolution about the corresponding axis lines may be used. In particular, if the dividing surfaces are surfaces of revolution which have cross sections resembling the cross section 80 in FIG. 18 (the symmetry line 81 is also shown in FIG. 18), then one may obtain a center piece which is in the shape of a sphere, and a corresponding center part of the oblique twistable 3-dimensional puzzle which has the shape of a sphere.

Figure 23:
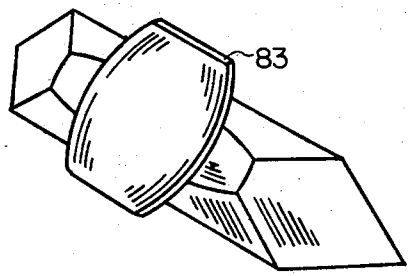
FIG. 23 is a perspective view of an edge part in an alternative embodiment.
Figure 25:
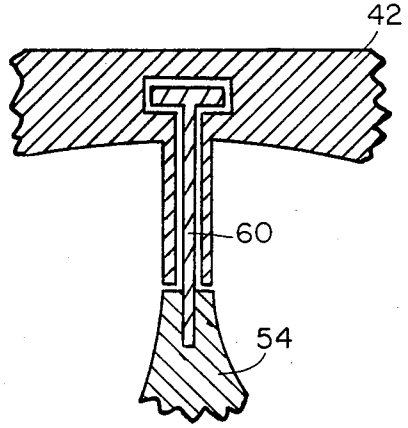
FIG. 25 is an enlarged cross sectional view of the means pivotally connecting the parts shown in FIG. 24.
Figure 24:
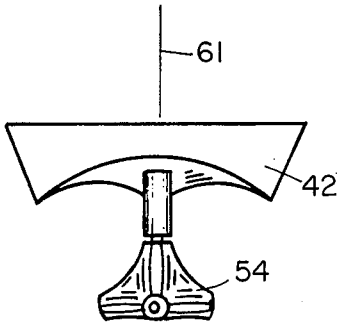
FIG. 24 is a pictorial view of a face part attached to the center part by one means pivotally connecting these parts.
Figure 26:
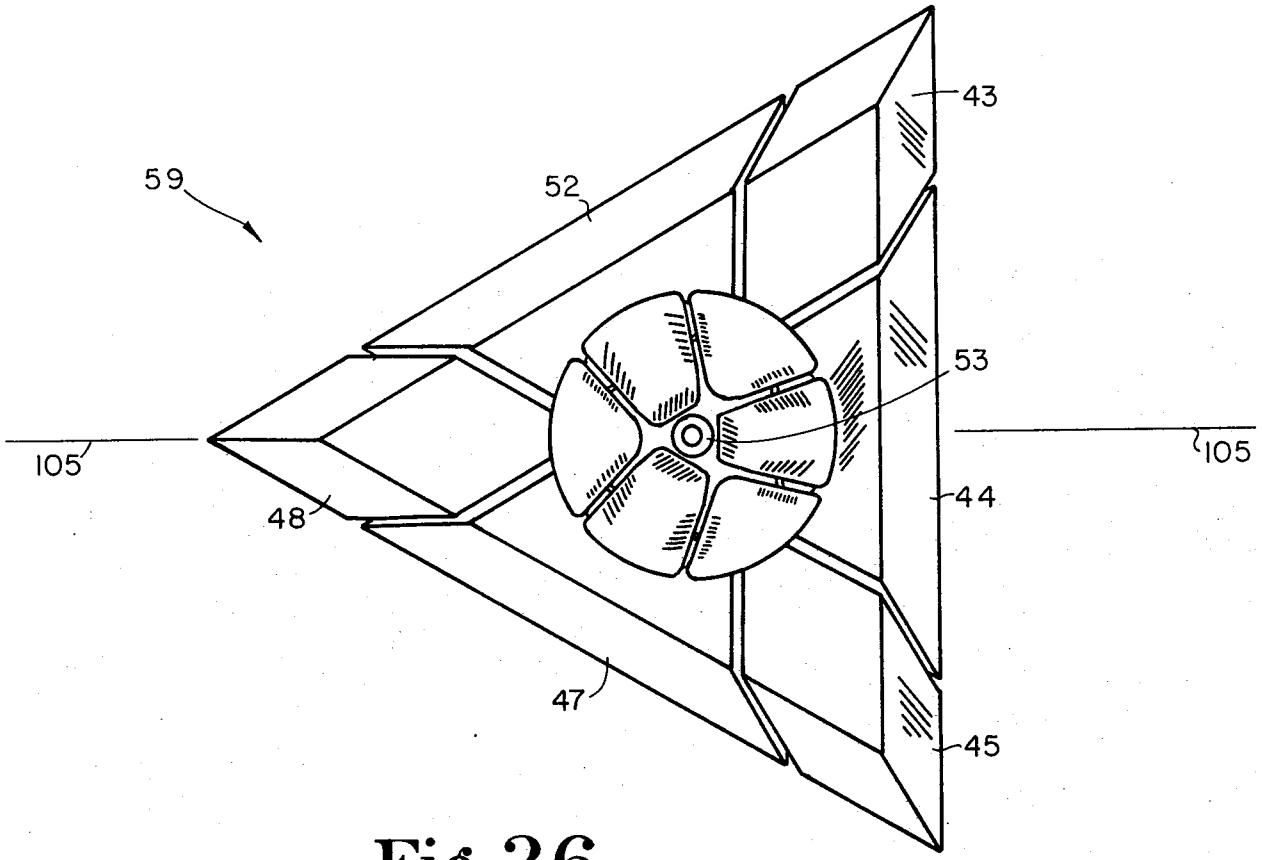
FIG. 26 is a top view of a block of the oblique twistable 3-dimensional puzzle of FIG. 8.

In the preferred embodiment described above, each of the extensions of the vertex and edge parts consists of one piece. In other embodiments the extensions may consist of more than one piece and may have different shapes. In particular, when the dividing surfaces have cross sections similar to the cross section 80 in FIG. 18, the center part of the oblique twistable 3-dimensional puzzle can have the shape of a sphere and the extensions 82 and 83 (see FIGS. 17 and 23) can then have shapes resembling portions of a spherical shell.

As described above in the description of the preferred embodiment, the parts of an oblique twistable 3-dimensional puzzle interlock so as to hold said parts together. This interlocking was described by referring to certain portions of the vertex and edge parts as extensions and corresponding shapes in the center part, edge parts and face parts as channels. This same interlocking of parts could also be described by referring to portions of the center part, face parts and edge parts as extensions and corresponding shapes in the vertex and edge parts as channels. In some embodiments of the present invention this second mode of description may seem more natural, yet the mode of description used in the preferred embodiment is intended to cover these other embodiments also. Yet another way to describe this interlocking of parts is to refer to the extensions 70 and 71 (see FIGS. 13, 14 and 22) of the vertex and edge parts as lug means and note how these lug means engage the inwardly facing surfaces (see FIGS. 19 and 22 and surfaces 106–108 for examples of inwardly facing surfaces) of the adjacent face parts and adjacent edge parts to hold the first mentioned vertex and edge parts to the rest of the assemblage 31. These inwardly facing surfaces do not correspond to any surfaces of the corresponding pieces of the subdivided guiding polyhedron 1. Interfacing surfaces of the parts of the assemblage 31 are those interior (i.e. interior to the said subdivided solid figure) surfaces of said parts which do correspond to interior surfaces of the pieces of the subdivided guiding polyhedron 1. See FIGS. 13, 14, 19 and 22 and surfaces 109–117 for examples of interfacing surfaces.

Figure 7:
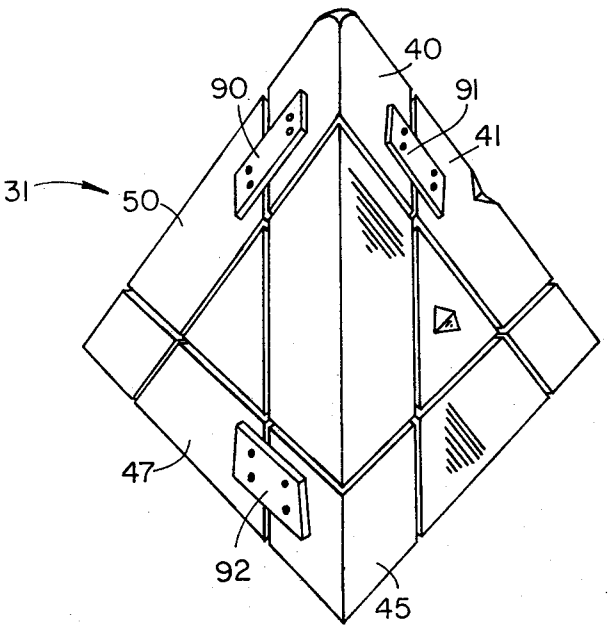
FIG. 7 is an edge view of an oblique twistable 3-dimensional puzzle with three fastening means.

In order to create additional puzzle challenges, fastening means may be used to fasten together certain pairs or parts of an oblique twistable 3-dimensional puzzle. In FIG. 7 fastening means 90, 91 and 92 are fastening vertex part 40 to edge part 50, vertex part 40 to edge part 41, and vertex part 45 to edge part 47 respectively. Parts thus fastened do not move relative to each other, and so an oblique twistable 3-dimensional puzzle with some of its parts so fastened has fewer rotational possibilities and presents a different puzzle challenge.

DISCUSSION OF SYMMETRIES

In the preferred embodiment described above, the guiding polyhedron 1 is a regular tetrahedron. Each face of a regular tetrahedron is 3-fold symmetric where a particular face of any polyhedron is N-fold symmetric for some integer N two or greater provided that when said polyhedron is rotated by 360°/N about the line perpendicular to said particular face and intersecting said particular face in its center, said particular face is carried exactly onto itself, and each face of said polyhedron adjacent to said particular face is carried exactly onto another face of said polyhedron adjacent to said particular face. A face of a polyhedron is symmetric if it is N-fold symmetric for some integer N two or greater.

The preferred embodiment described above is 3-fold symmetric with respect to each face of the guiding polyhedron where an oblique twistable 3-dimensional puzzle is N-fold symmetric with respect to a face of its guiding polyhedron provided there is an allowed arrangement such that after the block corresponding to said face is rotated by 360°/N about the axis line corresponding to said block, the parts of said oblique twistable 3-dimensional puzzle are arranged in a new allowed arrangement. An oblique twistable 3-dimensional puzzle is symmetric with respect to a face of its guiding polyhedron provided it is N-fold symmetric with respect to said face for some integer N two or greater.

Figure 35:
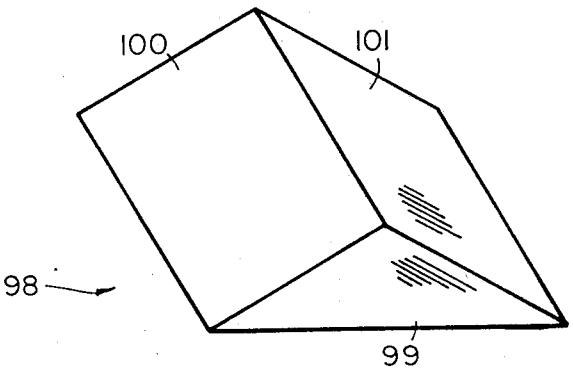
FIG. 35 is a perspective view of a prism with the front and back faces isosceles triangles.
Figure 34:
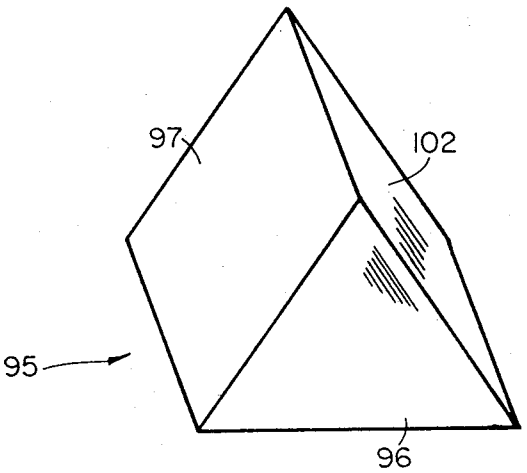
FIG. 34 is a perspective view of a prism with front and back faces equilaterial triangles.

In other embodiments of the present invention the guiding polyhedron will have faces which are N-fold symmetric for values of N different from 3. The following examples illustrate some of the possible symmetries a guiding polyhedron may have. In a regular dodecahedron each face is 5-fold symmetric. In the prism 95 illustrated in FIG. 34 the front face 96 and the back face (hidden from view) are equilateral triangles and are 3-fold symmetric. The three lateral faces 97, 102 and the bottom face hidden from view are rectangles and are 2-fold symmetric. In the prism 98 illustrated in FIG. 35, the front face 99 and the back face (hidden from view) are isosceles triangles which are not equilateral and they are each not symmetric. The two lateral faces 100 and 101 are not symmetric. The bottom face (hidden from view) is 2-fold symmetric. In a tetrahedron whose triangular faces are not equilateral triangles, all the faces are not symmetric.

We have, thus, defined the concept of N-fold symmetry for a face of an oblique polyhedron and the corresponding concept of N-fold symmetry with respect to said face of an oblique twistable 3-dimensional puzzle which has said oblique polyhedron as its guiding polyhedron. As illustrated in the preferred embodiment, each oblique polyhedron with one or more symmetric faces can be used as the guiding polyhedron for the description of an oblique twistable 3-dimensional puzzle which has the corresponding symmetries.

The invention claimed is:

1. A puzzle having a polyhedron shaped body, said puzzle comprising:

a central connecting component having more than 3 mounting means coupled to said central connecting component and outwardly extending therefrom, a plurality of face components, each of said face components being rotatably mounted on a different one of said mounting means, a plurality of edge components, having lug means thereon, the lug means of each edge component being engaged by inwardly facing surfaces of two face components holding said edge component at a predetermined distance from said central connecting component, a plurality of vertex components having lug means thereon, the lug means of each vertex component being engaged by inwardly facing surfaces on three of said edge components and three of said face components holding said vertex component at a predetermined distance from the central connecting component, and fastening means which fasten together one or more pairs of components of said puzzle to prevent movement of selected components relative to each other to create additional puzzle challenges.

2. The polyhedral puzzle set forth in claim 1, wherein each of said face components, edge components and vertex components is colored or otherwise decorated so that specific configurations of the components can be distinguished.

3. The polyhedral puzzle set forth in claim 1, wherein said central connecting component has 4 mounting means.

4. The polyhedral puzzle set forth in claim 1, wherein said central connecting component has 12 mounting means.

* * * * *